US006385887B1

(12) United States Patent
Johnston

(10) Patent No.: US 6,385,887 B1
(45) Date of Patent: May 14, 2002

(54) MUZZLE LOADING FIREARM AND ADAPTOR

(76) Inventor: Kenneth E. Johnston, 3470 Dobie Rd., Okemos, MI (US) 48864

( * ) Notice: Subject to any disclaimer, the term of this patent is extended or adjusted under 35 U.S.C. 154(b) by 0 days.

(21) Appl. No.: 09/588,928

(22) Filed: Jun. 7, 2000

(51) Int. Cl.[7] ..... F41C 7/00
(52) U.S. Cl. ..... 42/51; 102/444
(58) Field of Search ..... 42/51; 89/1.3; 102/464, 470

(56) References Cited

U.S. PATENT DOCUMENTS

| | | | | | |
|---|---|---|---|---|---|
| 2,708,878 | A | * | 5/1955 | Eckstein | 102/45 |
| 3,446,146 | A | * | 5/1969 | Stadler et al. | 102/45 |
| 3,780,464 | A | | 12/1973 | Anderson | |
| 3,818,834 | A | * | 6/1974 | Baumgartener | 102/41 |
| 4,222,191 | A | | 9/1980 | Lee et al. | |
| 4,232,468 | A | * | 11/1980 | Chapin | 42/77 |
| 4,391,199 | A | * | 7/1983 | Morin | 102/444 |
| 4,437,249 | A | | 3/1984 | Brown et al. | |
| 4,700,499 | A | | 10/1987 | Knight | |
| 4,715,139 | A | | 12/1987 | Rodney, Jr. | |
| 5,010,677 | A | | 4/1991 | Carron | |
| 5,133,143 | A | | 7/1992 | Knight | |
| 5,408,776 | A | | 4/1995 | Mahn et al. | |
| 5,467,551 | A | | 11/1995 | Kruse | |
| 5,623,779 | A | | 4/1997 | Rainey, III | |
| 5,657,569 | A | * | 8/1997 | Jernigan et al. | 42/83 |
| 5,706,598 | A | | 1/1998 | Johnston | |
| 5,737,863 | A | | 4/1998 | Rainey, III | |
| 5,860,240 | A | * | 1/1999 | Ball et al. | 42/51 |

OTHER PUBLICATIONS

Knight 1996 Catalog, p. 11, "Posi–Fire Ignition System".

* cited by examiner

*Primary Examiner*—Charles T. Jordan
*Assistant Examiner*—M. Thomson
(74) *Attorney, Agent, or Firm*—Ian C. McLeod; Mary M. Moyne

(57) ABSTRACT

An adaptor (10) which allows a standard cartridge firing action to be used with a muzzle loading firearm (100) is described. The adaptor includes a breech plug (12) and a nipple (16) and is configured to be inserted into the barrel (108) of the firearm adjacent the receiver (104). The breech end (16A) of the nipple (16) has a conical shape. In use, a standard ignition cartridge (150) with a casing (150A) and a head (150B) with a primer (154) mounted in the flash hole (152) in the head is loaded into the receiver of the firearm. Next, the ignition cartridge is moved into the breech end (108A) of the barrel such that the casing extends into the center bore (14) of the breech plug and the breech end of the nipple extends into the end (152B of the flash hole in the head of the cartridge and is adjacent the primer. When the firearm is fired, the firing pin (114A) contacts the primer which ignites the primer. The spark from the primer travels directly through the center bore of the nipple through the center openings of the propellant pellets (118) which ignites the propellant pellets which expels the projectile from the firearm.

28 Claims, 7 Drawing Sheets

MUZZLE LOADING FIREARM AND ADAPTOR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates to a muzzle loading firearm and in particular, an adaptor for mounting in the barrel of a firearm for allowing a cartridge firing action to be used with a muzzle loading firearm. The adaptor has a nipple with a conical shaped end which extends into the flash hole of the ignition cartridge and forms a sealing connection between the center bore of the nipple and the flash hole of the ignition cartridge which prevent fire and residue from escaping the flash hole and center bore.

(2) Description of the Related Art

My U.S. Pat. No. 5,706,598 describes a muzzle loading firearm having an insert (breech plug) and adaptor for use with a cartridge casing having a primer. The insert is threadably mounted in the center bore of the barrel adjacent the receiver. The nipple is threadably mounted in the center bore of the insert. However in my previous invention, the end of the nipple over which the cartridge casing is mounted is flat. Thus, the end of the nipple does not extend into the flash hole in the cartridge casing. Further, the flash hole of the cartridge casing opposite the primer is not sized to accommodate the end of the nipple. Thus, with my previous invention, the cartridge casing is not held in sealing contact with the nipple when the firearm is fired.

Other related art has shown various different inserts, adaptors and convertors which are used to convert a cartridge firing firearm into a black powder muzzle loading firearm. Illustrative are U.S. Pat. No. 4,437,249 to Brown et al and U.S. Pat. No. 4,222,191 to Lee et al. In Brown et al, the primer is mounted in the rear portion of the convertor. In Lee et al the powder is ignited by means of a percussion cap located on a nipple. Also of interest is U.S. Pat. No. 3,780,464 to Anderson which shows a firing mechanism for percussion lock firearms which allows the use of metallic cartridge primers.

Further, U.S. Pat. No. 5,408,776 to Mahn et al describes an improved ignition means for a muzzle loading firearm. In this invention, the ignition means is adapted to use a standard shotgun shell primer as the ignition source. However, the primer is mounted in a primer receiving well at one (1) end of the breech plug.

In addition, U.S. Pat. No. 5,623,779 and U.S. Pat. No. 5,737,863 both to Rainey, III describe a muzzle loading firearm utilizing an ignition device carrier. The ignition device carrier has a cylindrical housing with a centrally located opening recess in its aft end to receive the percussion excited ignition device such as a primer or percussion cap. The ignition device carrier has a counter bore to allow the carrier to be mounted on the aft end of the breech plug.

However, the end of the breech plug does not have a conical shape. In addition, the end of the breech plug does not extend into the flash hole of the ignition device carrier.

Also, of interest are U.S. Pat. No. 4,715,139 to Rodney, Jr.; U.S. Pat. No. 5,010,677 to Verney Carron and U.S. Pat. No. 5,467,551 to Kruse which show breech plug assemblies for muzzle loading firearms. Also, U.S. Pat. Nos. 4,700,499 and 5,133,143 both to Knight describe breech plugs for muzzle loading firearms. However, the nipples are adapted to receive a firing cap and percussion cap, respectively.

Only of minimal interest is Knight 1996 Catalog, page 11 showing the Posi-Fire Ignition System.

There remains the need for an adaptor which enables a cartridge firing action to be easily used for a muzzle loading firearm while providing sealed communication between the flash hole and the center bore of the nipple in the adaptor.

SUMMARY OF THE INVENTION

The present invention relates to an adaptor having a breech plug and a nipple which enables a cartridge firing action to be used in the muzzle loading firearm. The breech plug is mounted in the center bore of the barrel adjacent the breech end of the barrel. The nipple is mounted in the center bore of the breech plug. The breech end of the nipple has a conical shape. The ignition cartridge having the primer is mounted over the nipple. The ignition cartridge is preferably similar to a standard rifle ignition cartridge without the bullet or powder. The breech end of the nipple extends into the flash hole of the ignition cartridge adjacent the primer. When the bolt or other blocking mechanism is moved into firing position, the ignition cartridge is moved securely onto the nipple. In the instant the firearm is fired, contact of the firing pin with the primer moves the ignition cartridge into sealed contact with the nipple which prevents the ignition fire and ignition gases from escaping between the flash hole and the center bore of the nipple. In addition, since the center bore of the nipple is in sealed communication with the flash hole of the ignition cartridge, the ignition flash of the primer immediately travels through the center bore of the nipple and the center bore of the breech plug to the propellant pellets or black powder located in the center bore of the barrel.

Further, in accordance with the invention, the flash hole of the ignition cartridge opposite the primer can be chamfered by a chamfering tool such that the breech end of the nipple can extend into the flash hole to be located adjacent the primer.

The substance and advantages of the present invention will become increasingly apparent by reference to the following drawings and the description.

The present invention relates to an adaptor for use in a muzzle loading firearm, having a receiver mounting a barrel and a blocking means movably mounted on the receiver for supporting a head of a cartridge during firing of the firearm, the blocking means mounting a firing pin mechanism, the adaptor comprising: a plug having a first end and a second end with a sidewall extending therebetween and with a center bore extending therethrough along a longitudinal axis of the plug, the plug being configured to be inserted into the barrel in a sealed relationship to the barrel with the first end adjacent the blocking means; and a nipple mounted in the center bore of the plug and having a first end and a second end with a sidewall extending therebetween and with a center bore extending therethrough in communication with the center bore of the plug, the sidewall at the first end having an angled outer surface wherein the sidewall of the nipple is spaced apart from the sidewall of the plug such that a casing of the cartridge with a primer on a head of the casing can be mounted on the nipple, the head of the casing having an opening adjacent the primer on a side adjacent the nipple, wherein the casing extends into the center bore of the plug adjacent the sidewall of the plug such that the first end of the nipple extends into the opening of the casing adjacent the primer and such that when the blocking means engages the head of the casing of the cartridge with the firing pin mechanism adjacent the primer and moves the first end of the nipple into the opening of the casing such that the center bore of the nipple is in direct communication with the primer wherein during firing of the muzzle loading firearm, the firing pin mechanism engages the primer and produces ignition of propellant material in the barrel through the center bore of the plug and the center bore of the nipple.

Further, the present invention relates to an ignition system for use in a muzzle loading firearm having a receiver and a barrel with a blocking means slidably mounted on the receiver and mounting a firing pin mechanism, the ignition system comprising: a plug having a first end and a second end with a sidewall extending therebetween and with a center bore extending therethrough along a longitudinal axis of the plug, the plug being configured to be inserted into the barrel in a sealed relationship to the barrel with the first end adjacent the blocking means; a nipple mounted in the center bore of the plug and having a first end and a second end with a sidewall extending therebetween and with a center bore extending therethrough in communication with the center bore of the plug, the sidewall at the first end having an angled outer surface wherein the sidewall of the nipple is spaced apart from the sidewall of the plug; and a cartridge configured to be mounted over the first end of the nipple and into the center bore of the plug, the cartridge having a head with a casing extending outward from the head, the head having a primer on one side and an opening adjacent the primer wherein an end of the opening opposite the primer is configured to accommodate the first end of the nipple such that when the blocking means engages the head of the casing of the cartridge with the firing pin mechanism adjacent the primer and moves the cartridge over the nipple, the first end of the nipple moves into the opening of the casing such that the center bore of the nipple is in fluid communication with the primer, wherein during firing of the muzzle loading firearm, the firing pin mechanism engages the primer and produces ignition of propellant material in the barrel through the center bore of the plug and the center bore of the nipple.

Further still, the present invention relates to a muzzle loading firearm having a receiver mounting a barrel and having a blocking means for holding a cartridge during firing of the firearm and mounting a firing pin mechanism, the improvement which comprises as part of the barrel: a center bore provided by an inside wall in the barrel having a first section adjacent the receiver and an opposed third section with a second section therebetween extending along a longitudinal axis of the barrel, a diameter of the first section being less than a diameter of the third section and the second section having a frusto-conical shape with a first end adjacent the first section and a second end adjacent the third section wherein a diameter of the first end is less than a diameter of the second end; and a nipple having a first end and a second end and mounted in the first and second sections of the center bore and having a first section adjacent the first end and a second section adjacent the second end with a bore extending therethrough in communication with the third section of the center bore the first section having an outside wall in spaced relationship to the inside wall of the barrel, the second section of the nipple having a frusto-conical shape and configured to be mounted in the second section of the center bore, the nipple configured to mount a casing of the cartridge with a primer in a head of the casing and an opening in the head of the casing adjacent the primer so that the casing extends into a first section of the center bore adjacent the inside wall of the barrel and the nipple extends into the opening of the casing adjacent the primer and so that the blocking means engages the head of the casing of the cartridge with the firing pin mechanism adjacent the primer and moves the first end of the nipple into the opening in the head of the casing, wherein during firing of the muzzle loading firearm, the firing pin engages the primer and produces ignition of powder in the third section of the center bore through the bore of the nipple.

Still further, the present invention relates to a method for providing a muzzle loading firearm, with a receiver mounting a barrel and a blocking means which supports a head of a cartridge during firing of the firearm, the blocking means mounting a firing pin mechanism, the method which comprises the steps of: mounting a plug in the barrel, the plug having a first end and a second end with a sidewall extending therebetween and with a center bore extending therethrough along a longitudinal axis of the plug, the plug being configured to be inserted into the barrel in a sealed relationship to the barrel with the first end adjacent the blocking means; and mounting a nipple in the center bore of the plug, the nipple having a first end and a second end with a sidewall extending therebetween and with a center bore extending therethrough in communication with the center bore of the plug, the sidewall at the first end having an angled outer surface wherein the sidewall of the nipple is spaced apart from the sidewall of the plug such that a casing of the cartridge with a primer on a head of the casing can be mounted on the nipple, the head of the casing having an opening adjacent the primer on a side adjacent the nipple wherein the casing extends into the center bore of the plug adjacent the sidewall of the plug such that the first end of the nipple extends into the opening of the casing adjacent the primer and such that the blocking means engages the head of the casing of the cartridge with the firing pin mechanism adjacent the primer and moves the first end of the nipple into the opening of the casing such that the center bore of the nipple is in fluid communication with the primer, wherein during firing of the muzzle loading firearm the firing pin mechanism engages the primer and produces ignition of powder in the barrel through the center bore of the plug and through the center bore of the nipple.

Further, the present invention relates to a method for firing a muzzle loading firearm, the firearm having a receiver mounting a barrel and having a blocking means for holding a head of a cartridge during firing of the firearm and mounting a firing pin mechanism, the muzzle loading firearm having as part of the barrel, a center bore provided by an inside wall in the barrel, the center bore having a first section adjacent the receiver and an opposed third section with a second section therebetween extending along a longitudinal axis of the barrel, a diameter of the first section being less than a diameter of the third section and the second section having a frusto-conical shape with a first end adjacent the first section and a second end adjacent the third section wherein a diameter of the first end is less than a diameter of the second end; and a nipple having a first end and a second end and mounted in the first and second sections of the center bore and having a first section adjacent the first end and a second section adjacent the second end and a bore extending therethrough in communication with the third section of the center bore, the first section having an outside wall in spaced relationship to the inside wall of the barrel, the second section of the nipple having a frusto-conical shape and configured to be mounted in the second section of the center bore, the nipple configured to mount a casing of the cartridge with a primer in a head of the casing and an opening in the head of the casing adjacent the primer so that the casing extends into a first section of the center bore adjacent the inside wall of the barrel and the nipple extends into the opening of the casing adjacent to the primer and so that the blocking means of the receiver engages the head of the casing of the cartridge with the firing pin mechanism adjacent the primer and moves the first end of the nipple into the opening in the head of the casing, wherein during firing of the muzzle loading firearm, the firing pin engages the primer and produces ignition of powder in the third section of the center bore through the bore of the nipple, the method which comprises the steps of: inserting firearm powder into a third section of the center bore opposite the receiver; inserting a projectile into the third section of the center bore adjacent the powder; inserting the casing of the cartridge with the primer on the head of the casing in a breech opening of the firearm adjacent the blocking means; moving the blocking means toward the barrel of the firearm wherein the blocking means engages the head of the cartridge with the firing pin mechanism adjacent the primer and the casing is mounted on the first end of the nipple and extends into the first section of the center bore so that the nipple extends into the opening in the head of the cartridge adjacent the primer; and pulling a trigger of the firearm such that the firing pin mechanism engages the primer and produces ignition of the powder through the bore in the nipple and causes an explosion which expels the projectile from the third section of the center bore of the barrel wherein during the explosion, the casing of the cartridge expands such as to provide a sealed relationship with the first section of the center bore.

Still further, the present invention relates to a method for firing a muzzle loading firearm, with a receiver for mounting the barrel and a blocking means for supporting a head of a cartridge in the barrel during firing of the firearm, the blocking means mounting a firing pin mechanism, the method which comprises the steps of: providing in the barrel and adjacent the receiver, a plug having a first end and a second end with a sidewall extending therebetween and with a center bore extending therethrough along a longitudinal axis of the plug, the plug being configured to be inserted into the barrel in a sealed relationship to the barrel with the first end adjacent the blocking means; and a nipple mounted in the center bore of the plug and having a first end and a second end with a sidewall extending therebetween and with a center bore extending therethrough in fluid communication with the center bore of the plug, the sidewall at the first end having an angled outer surface wherein the sidewall of the nipple is spaced apart from the sidewall of the plug such that a casing of the cartridge with a primer on a head of the casing can be mounted on the nipple, the casing having an opening adjacent the primer on a side adjacent the nipple; inserting firearm powder into an end of the barrel of the firearm opposite the receiver so that the powder is adjacent the second end of the plug; inserting a projectile into the end of the barrel of the firearm opposite the receiver adjacent the powder; inserting the casing of the cartridge with the primer on the head of the casing in the receiver of the firearm adjacent the blocking means; moving the blocking means toward the barrel of the firearm wherein the blocking means engages the head of the cartridge with the firing pin mechanism adjacent the primer and the casing is mounted on the nipple and extends into the center bore of the plug adjacent the sidewall of the plug and wherein the first end of the nipple extends into the opening in the head of the cartridge adjacent the primer and is in direct fluid communication with the primer; and pulling a trigger of the firearm such that the firing pin mechanism engages the primer and produces ignition of the powder through the center bore of the plug and the center bore of the nipple and causes an explosion which expels the projectile from the end of the barrel of the firearm opposite the receiver, wherein during the explosion, the casing of the cartridge expands such as to provide a sealed relationship with the sidewall of the center bore of the plug.

Further still, the present invention relates to a cartridge for use with a muzzle loading firearm having a receiver and a barrel with a blocking means slidably mounted on the receiver and mounting a firing pin mechanism, the barrel having a center bore with a nipple, the nipple having a frusto-conical shape at one end adjacent the receiver, the nipple having a bore in fluid communication with the center bore of the barrel, the cartridge which comprises: a head with opposed ends with a flash hole in one end, the flash hole having an opening in a bottom wall which extends through to the other end of the head, the opening being configured to accommodate the end of the nipple having the frusto-conical shape such that the bore of the nipple is in fluid communication with the flash hole; a casing integral with the head on the end of the head opposite the flash hole and extending outward from the head in a direction opposite the flash hole and having a chamber and an open end opposite the head, the casing being configured to be mounted over the end of the nipple such that the end of the nipple extends into the open end of the casing and into the chamber and into the opening in the flash hole in the head; and a primer mounted in the flash hole in the head wherein when the blocking means engages the head with the firing pin mechanism adjacent the primer and moves the cartridge over the nipple, the end of the nipple moves into the opening in the flash hole in the head such that the bore of the nipple is in fluid communication with the primer, wherein during firing of the muzzle loading firearm, the firing pin mechanism engages the primer and produces ignition of powder in the barrel through the center bore and the bore of the nipple.

Finally, the present invention relates to a method of producing a cartridge for use with a muzzle loading firearm having a receiver and a barrel with a blocking means slidably mounted on the receiver and mounting a firing pin mechanism, the barrel having a center bore with a nipple, the nipple having a frusto-conical shape at one end adjacent the receiver, the nipple having a bore in fluid communication with the center bore of the barrel, the method comprising the steps of: providing a standard cartridge having a head with opposed ends with a flash hole in one end with a primer mounted in the flash hole, the flash hole having an opening in a bottom wall which extends through to the other end of the head; a casing integral with the head on the end of the head opposite the flash hole and extending outward from the head in a direction opposite the flash hole and having a chamber and an open end opposite the head, the casing being configured to be mounted over the end of the nipple such that the nipple extends into the end of the casing and into the chamber and into the opening in the flash hole in the head; providing a tool having a handle and a chamfering bit; extending the chamfering bit of the tool into the open end of the casing through the chamber and into the opening in the flash hole in the head of the cartridge; and grasping the handle of the tool and rotating the tool so that the chamfering bit rotates in the opening in the head of the cartridge and chamfers an end of the opening opposite the primer so that when the blocking means engages the head with the firing pin mechanism adjacent the primer and moves the cartridge over the nipple, the end of the nipple moves into the opening in the flash hole in the head such that the bore of the nipple is in fluid communication with the primer wherein during firing of the muzzle loading firearm, the firing pin mechanism engages the primer and produces ignition of powder in the barrel through the center bore and the bore of the nipple.

DETAILED DESCRIPTION OF THE PREFERRED EMBODIMENTS

Figure 1:
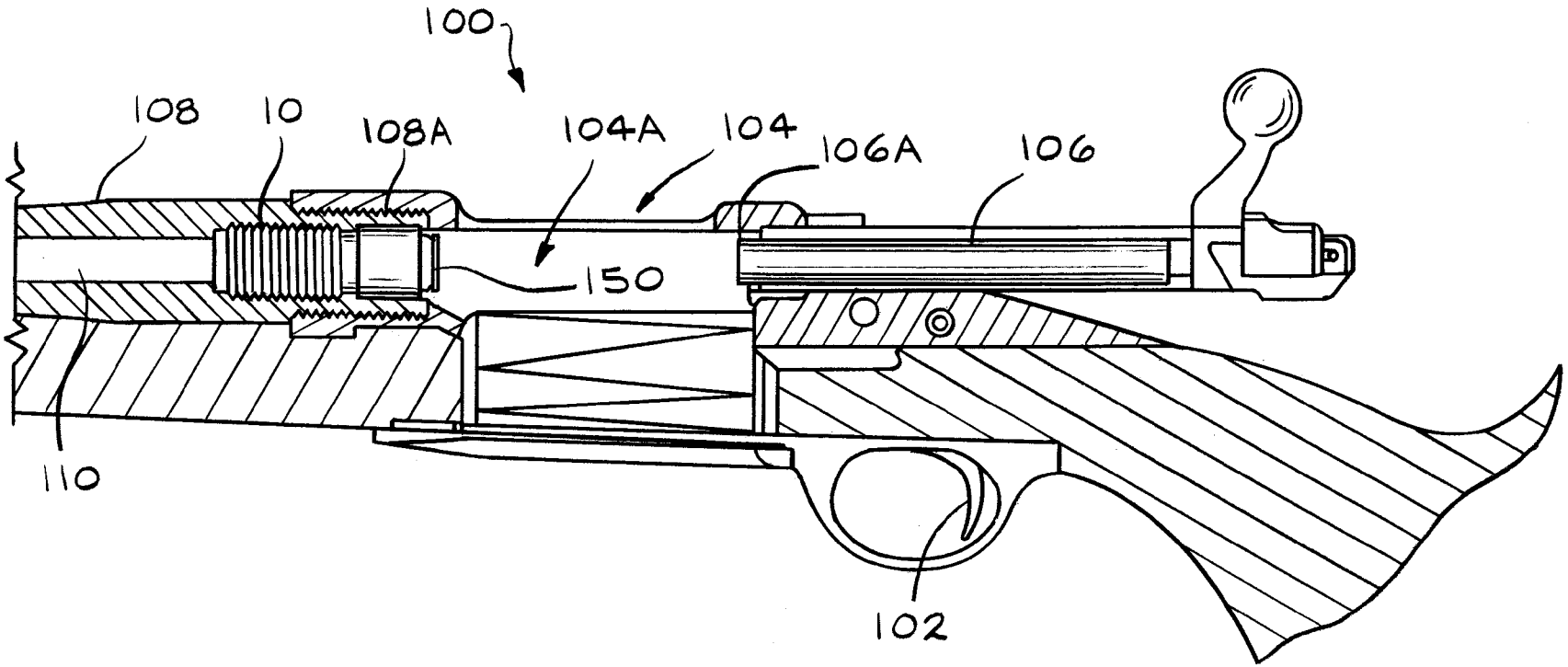
FIG. 1 is a side cross-sectional view of a muzzle loading firearm 100 with the bolt 106 in the retracted position showing the adaptor 10 of the present invention mounted in the breech end 108A of the barrel 108.

The term "action" as used herein includes the receiver with the bolt and firing pin assembly and the trigger of the firearm. The action of the firearm may or may not include the barrel and does not include the stock of the firearm.

As used herein, the term "ignition cartridge" refers to a standard cartridge having the head, casing and primer without the bullet. The ignition cartridge also does not include loose powder. The term includes metallic ignition cartridges as well as shotgun shell casings.

The adaptor 10 of the present embodiment is preferably mounted in a muzzle loading firearm 100. The adaptor 10 is configured to be used with a standard cartridge firing rifle action and a standard muzzle loading barrel 108 to allow the action to be used as part of a muzzle loading firearm 100. It is understood that the adaptor 10 can be used in any type of firearm 100 which uses a standard cartridge including pistols, rifles and shotguns. For instance, the adaptor 10 can be mounted in the chamber of a revolver.

In the preferred embodiment, the muzzle loading barrel 108 is used with a modern action. The bolt action is preferably similar to a standard bolt action used in modern rifles. The action includes a securer or receiver 104, a trigger 102 and a bolt 106. The muzzle loading firearm 100 preferably includes a barrel 108 having a rearward or breech end 108A and a forward end 108B with a center bore 110 extending therethrough. The barrel 108 of the firearm 100 is mounted at the breech end 108A to the breech opening 104A of the receiver 104. In the preferred embodiment, the barrel 108 is sealably threaded into the breech opening 104A of the receiver 104. The receiver 104 could also be a frame such as with a pistol or some other means for securing the barrel 108 to the action in the firearm 100. The receiver 104 includes a breech opening 104A in which the bolt 106 is mounted which serves to block or hold the ignition cartridge 150 in position in the center bore 110 of the barrel 108. The bolt action is preferably a sliding or inline bolt action. The bolt 106 is preferably similar to that used in standard, modern bolt action firearms. In this embodiment, the bolt 106 is axially aligned with the center bore 110 of the barrel 108 adjacent the breech end 108A of the barrel 108. The bolt 106 has an extractor (not shown) with a hook (not shown) at the breech end 106A for grasping the head 150B of the ignition cartridge 150 and moving the ignition cartridge 150 into position for firing and ejecting the ignition cartridge 150 after firing when the bolt 106 is moved away from the barrel 108 of the firearm 100. Preferably, the extractor and face of the bolt 106 are modified from a conventional magazine feed so that the ignition cartridge 150 can be inserted onto the face of the bolt 106 and held in place on the face of the bolt 106 by the extractor. The bolt 106 includes a firing pin assembly having a firing pin 112. The bolt 106 is also provided with camming locks (not shown) adjacent the breech end 106A which lock the bolt 106 and the ignition cartridge 150 in place to enable the firing pin 112 to contact the primer 154 during firing. Although the adaptor 10 is preferably used with a firearm 100 having a sliding bolt action, the adaptor 10 can also be used in firearms 100 having a rolling block action (not shown) or a falling block action (not shown).

Figure 6:
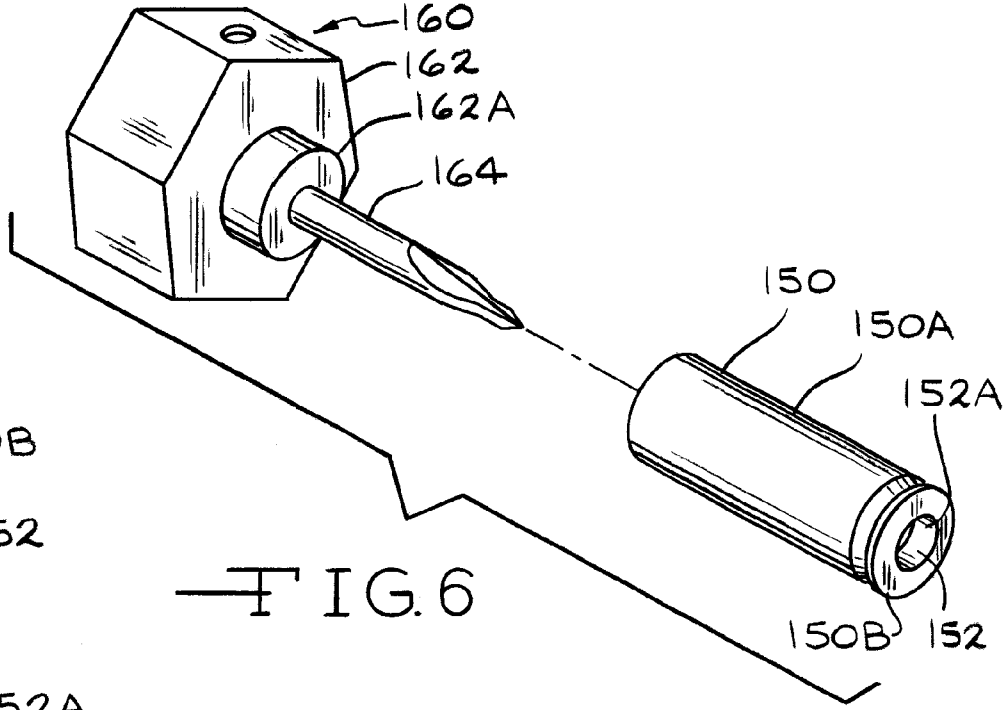
FIG. 6 is a perspective view of the ignition cartridge 150 and the chamfering tool 160.
Figure 7:
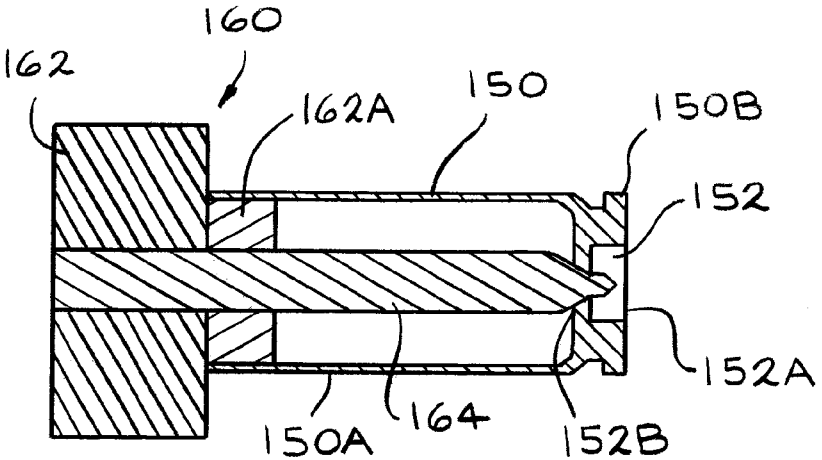
FIG. 7 is a cross-sectional view showing the chamfering tool 160 in use in the ignition cartridge 150.

In the preferred embodiment, when using the sliding bolt action with a muzzle loading firearm 100, a standard cartridge is used to form the ignition cartridge 150. In the preferred embodiment, the ignition cartridge 150 is similar to a 45 ACP casing. The ignition cartridge 150 includes a casing 150A with a head 150B having a flash hole 152 in the head 150B with a primer 154. The primer 154 is mounted in a well 152A at the end 152B of the flash hole 152, opposite the casing 150A. The end 152B of the flash hole 152 opposite the well 152A and primer 154 is preferably chamfered to enable the breech end 16A of the nipple 16 to extend into the end 152B of the flash hole 152. In the preferred embodiments, the ignition cartridge 150 is formed using a standard cartridge. In some embodiments when a standard cartridge is used to form the ignition cartridge 150, the end of a flash hole 152 opposite the well 152A has a diameter which allows the breech 16A of the nipple 16 to extend into the end 152B of the flash hole 152. In other embodiments where a standard ignition cartridge is used, the end 152B of the flash hole 152 must be chamfered to increase the diameter of the flash hole 152. A chamfering tool 160 is preferably used to chamfer the flash hole 152 (FIGS. 6 and 7). The chamfering tool 160 includes a handle 162 and a bit 164. To chamfer the flash hole 152, the bit 164 of the chamfering tool 160 is inserted into the cartridge casing 150A of the ignition cartridge 150 through the end opposite the head 150B. The tool 160 is extended until the handle 162 contacts the end of the cartridge casing 150A. As the tool 160 is moved into the cartridge casing 150A, the tool 160 is rotated. As the tool 160 moves into the cartridge casing 150A, the end of the bit 164 enters the end 152B of the flash hole 152. Rotation of the tool 160 allows the bit 164 to cut or grind the inside of the flash hole 152 to increase the diameter of the flash hole 152. In the preferred embodiment, the handle 162 of the chamfering tool 160 has a guide flange 162A on a side adjacent the bit 164. The guide flange 162A has a diameter slightly less than the inner diameter of the cartridge casing 150A. The guide flange 162A acts to center the tool 160 in the cartridge casing 150A such that the bit 164 enters the center of the flash hole 152 to allow for symmetrical chamfering of the flash hole 152. The ignition cartridge 150 is used to provide the primer 154 for firing the muzzle loading firearm 100.

Figure 2:
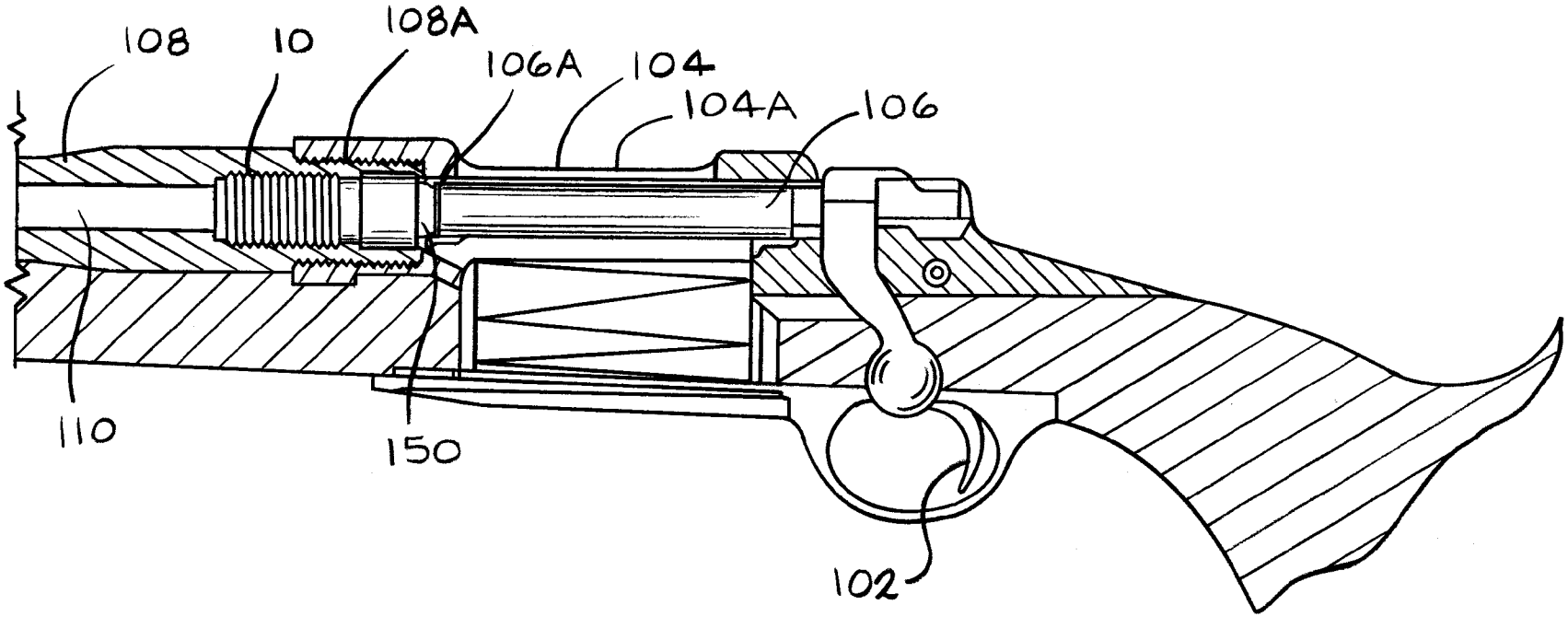
FIG. 2 is a side cross-sectional view of a muzzle loading firearm 100 with the bolt 106 in the firing position showing the adaptor 10 mounted in the breech end 108A of the barrel 108.
Figures 3, 4:
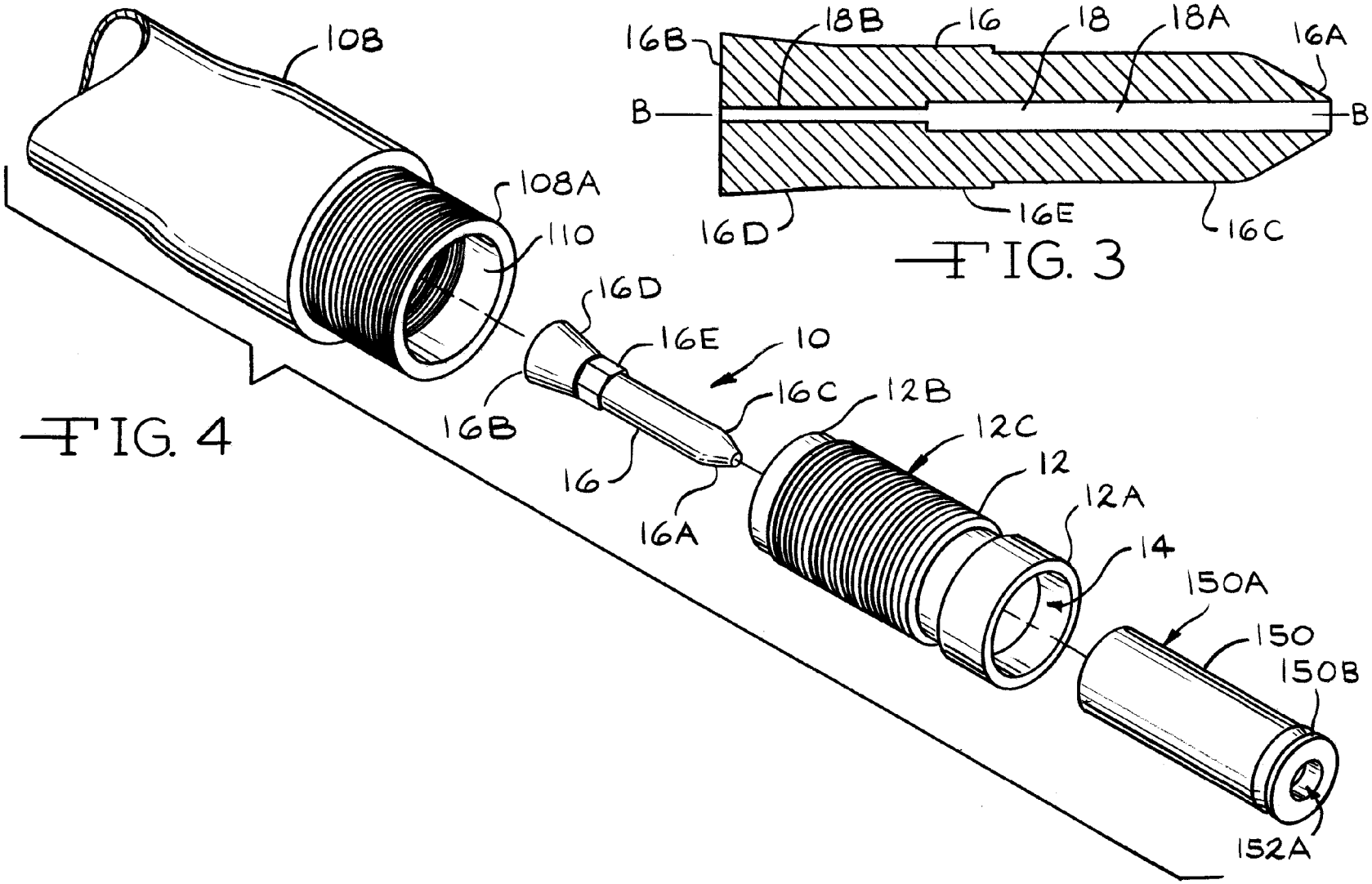
FIG. 3 is a cross-sectional view of the nipple 16 showing the center bore 14.
FIG. 4 is an exploded view of the adaptor 10 and ignition cartridge 150.
Figure 5:
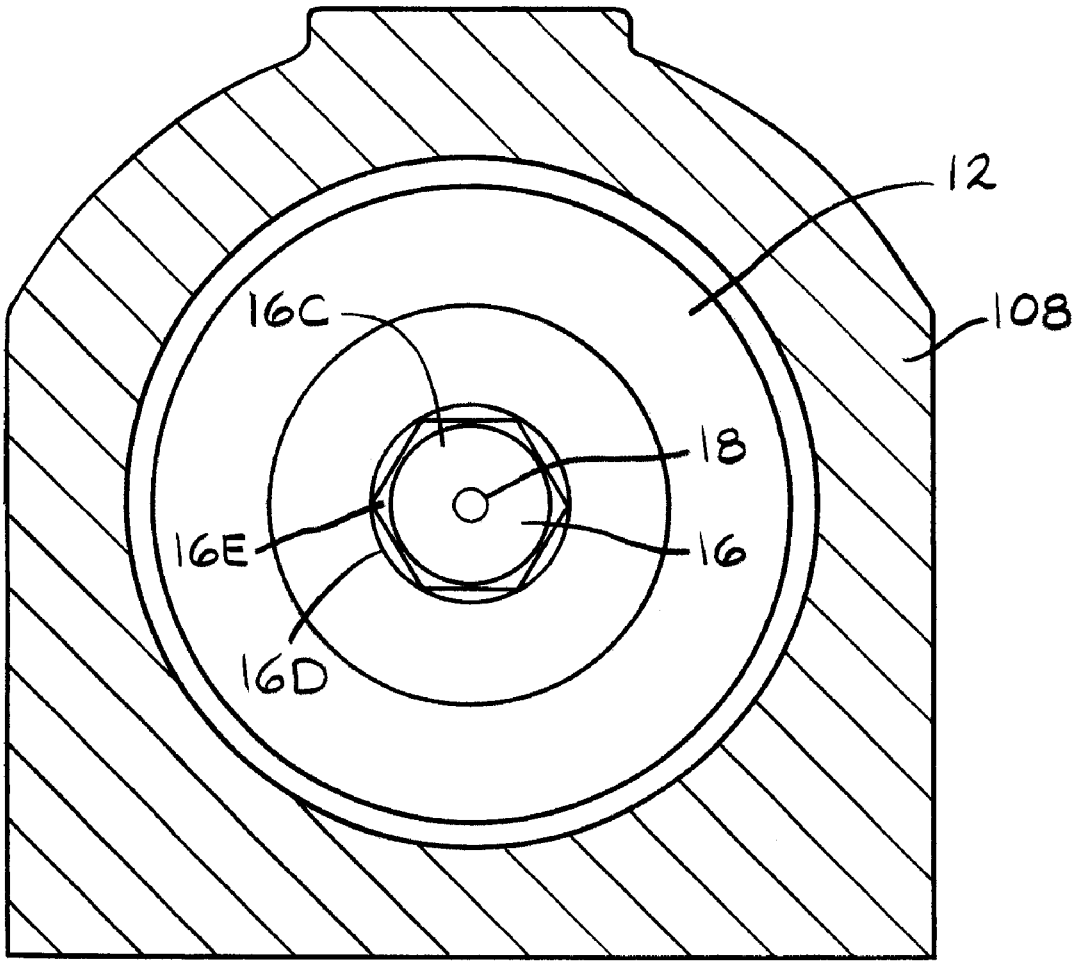
FIG. 5 is an end cross-sectional view through the breech end 108A of the barrel 108 showing the breech plug 12 and nipple 16.
Figure 8:
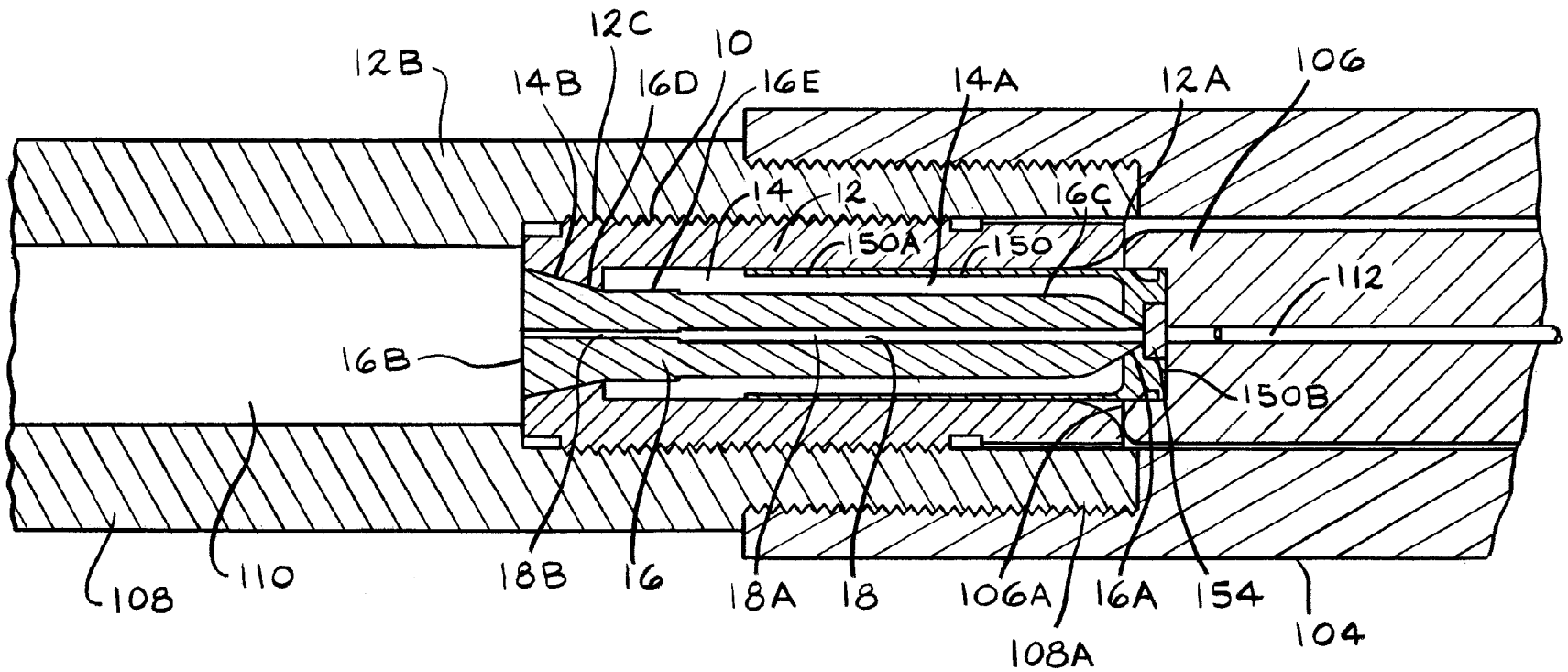
FIG. 8 is a partial cross-sectional view of the breech end 108A of the barrel 108 with the bolt 106 in the firing position showing the breech plug 12, nipple 16 and ignition cartridge 150.
Figure 9:
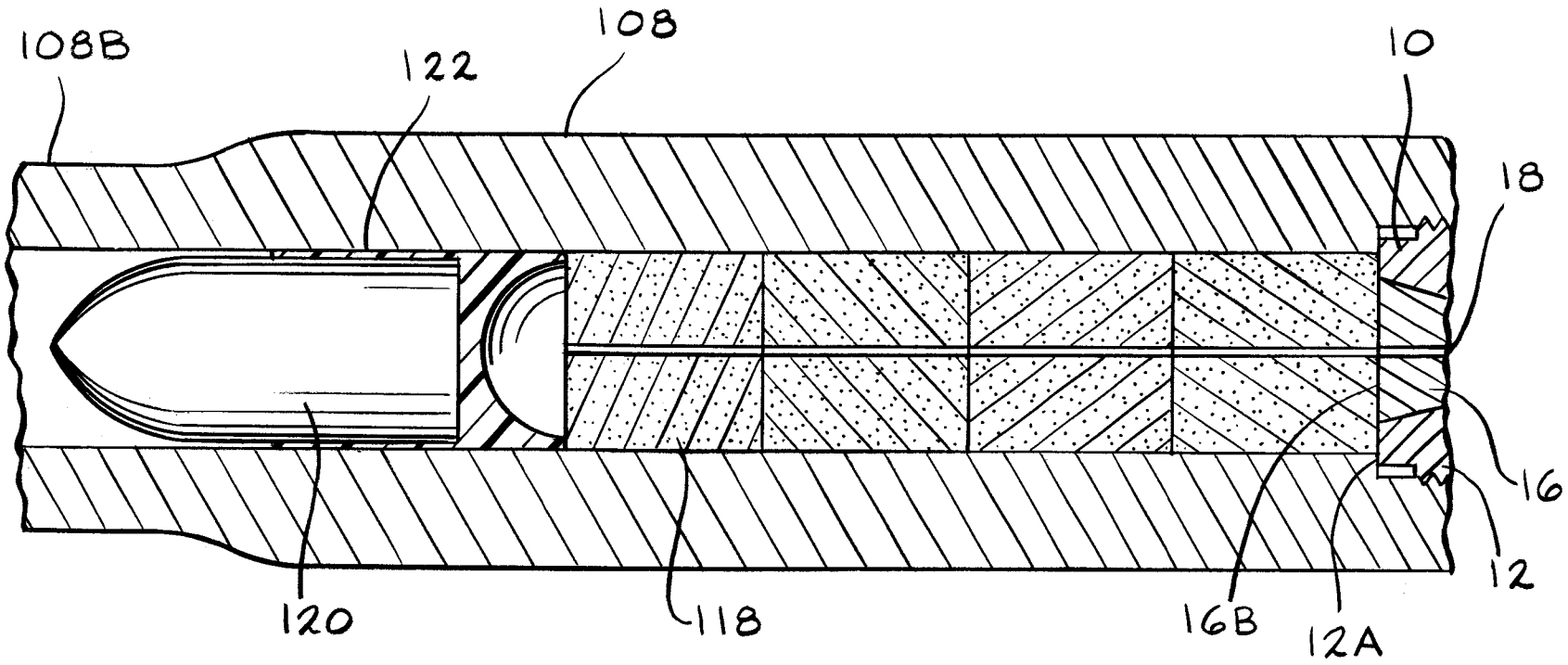
FIG. 9 is a partial cross-sectional view of the barrel 108 adjacent the forward end 12B of the breech plug 12 showing the propellent pellets 118, the sabot 122 and the bullet 120.

FIGS. 1 and 2 show the adaptor 10 of the present invention mounted in the breech end 108A of the barrel 108 adjacent the receiver 104 of a firearm 100. The adaptor 10 includes a breech plug 12 and a nipple 16. The breech plug 12 is preferably cylindrical in shape having an open rearward or breech end 12A and an open forward end 12B with a sidewall 12C extending therebetween forming a center bore 14 therethrough along the longitudinal axis A—A of the breech plug 12. The center bore 14 extends completely through the breech plug 12. The outer diameter of the breech plug 12 is preferably slightly less than the diameter of the center bore 110 of the barrel 108 of the firearm 100 such that the breech plug 12 is easily inserted and secured in the center bore 110 of the barrel 108 of the firearm 100. In the preferred embodiment, the sidewall 12C of the breech plug 12 has threads on the outer surface adjacent the forward end 12B of the breech plug 12. However, it is understood that any portion of the outer surface of the insert can be provided with threads as needed to securely mount the adaptor 10 in the center bore 110 of the barrel 108. The center bore 110 of the barrel 108 is preferably provided with threads adjacent the breech end 108A. The threads of the breech plug 12 engage the threads of the center bore 110 of the barrel 108 such that the adaptor 10 is sealably mounted in the center bore 110 of the barrel 108 (FIG. 8). However, it is understood that the breech plug 12 can be removably mounted in the center bore 110 of the barrel 108 by any well known means. The breech plug 12 can also be permanently mounted in the center bore 110 of the barrel 108 by any well known means. In the preferred embodiment, the adaptor 10 is removably mounted in the muzzle loading barrel 108 of the firearm 100. However, it will be appreciated that the firearm 100 can be manufactured with the adaptor 10 as an integral part of the barrel 108. However, in the preferred embodiment, the adaptor 10 is mounted within the barrel 108 after the firearm 100 has been manufactured. Preferably, the outer surface of the breech plug 12 adjacent the breech end 12A is smooth with an outer diameter slightly less than the diameter of the center bore 110 of the barrel 108. In the preferred embodiment, the center bore 110 of the barrel 108 adjacent the breech end 108A of the barrel 108 has a diameter of 0.625 inch (1.59 cm) and preferably, the outer diameter of the breech plug 12 is slightly less than 0.625 inch (1.59 cm) unthreaded. The center bore 14 of the breech plug 12 preferably has a first section 14A and a second section 14B. The first section 14A is adjacent the rearward or breech end 12A of the breech plug 12 and extends through a majority of the breech plug 12. The first section 14A of the center bore 14 of the breech plug 12 provides a chamber in the barrel 108 for mounting the ignition cartridge 150. The inner sidewall of the first section 14A is preferably smooth and chamfered adjacent the breech end 12A of the plug 12 to allow for easier insertion of the ignition cartridge 150. The inner diameter of the first section 14A of the center bore 14 is preferably slightly larger than the outer diameter of the casing 150A of the ignition cartridge 150 such that the ignition cartridge 150 is easily inserted into the first section 14A of the center bore 14 (FIG. 8). In the preferred embodiment, the first section 14A has a diameter of 0.458 inch (1.16 cm) to fit a 45 ACP ignition cartridge. The length of the first section 14A of the center bore 14 is preferably longer than the length of the casing 150A of the ignition cartridge 150 such that when the ignition cartridge 150 is inserted into the center bore 14, the head 150B of the ignition cartridge 150 is adjacent the breech end 12A of the breech plug 12 (FIG. 1). The second section 14B of the center bore 14 preferably has a conical frusto-shape with the apex adjacent the first section 14A of the center bore 14 (FIG. 8). The breech plug 12 preferably has a length 1.5 inches (2.3 cm) and is constructed of stainless steel.

The nipple 16 is configured to be permanently mounted in the center bore 14 of the breech plug 12. The nipple 16 can also be constructed as an integral part of the breech plug 12. The nipple 16 has a rearward or breech end 16A and a forward end 16B with a center bore or flash hole 18 extending completely through the nipple 16. The sidewall of the nipple 16 preferably has a first section 16C adjacent the breech end 16A and a second section 16D adjacent the forward end 16B with a third section 16E extending therebetween. The first section 16C of the nipple 16 is essentially cylindrical having a conical shape with a truncated apex at the breech end 16A with the truncated apex of the cone forming the breech end 16A of the nipple 16. The diameter of the nipple 16 at the breech end 16A as formed by the apex of the conical shaped outer surface is essentially equal to the diameter of the center bore 18 of the nipple 16 at the breech end 16A. In the preferred embodiment, the outer surface of the sidewall of the nipple 16 at the breech end 16A has a 60° angle from the longitudinal axis A—A of the nipple 16. Preferably, the diameter of the first section 16C is smaller than the inner diameter of the casing 150A of the ignition cartridge 150 such that the ignition cartridge 150 is easily mounted over the nipple 16. The second section 16D of the nipple 16 has a flared or frusto-conical shape with the truncated apex of the cone adjacent the third section 16E of the nipple 16. The shape of the second section 16D of the nipple 16 is similar to the shape of the second section 14B of the center bore 14 of the breech plug 12. The third section 18C of the nipple 16 preferably has a hexagonal shape to accommodate a wrench (not shown) which allows for removal of the adaptor 10 from the barrel 108. The center bore 18 of the nipple 16 preferably has a first section 18A and a second section 18B along its length. The first section 18A adjacent the breech end 16A of the nipple 16 preferably has a greater diameter than the second section 18B adjacent the forward end 16B of the nipple 16. In an alternative embodiment, the first section 18A gradually tapers into the second section 18B to allow for smoother flow of the ignition gases. In the preferred embodiment, the first section 18A of the center bore 18 of the nipple 16 has a diameter of 0.065 inches (0.165 cm) and the second section 18B has a diameter of 0.050 inch (0.127 cm). The nipple 16 preferably has a length of about 1.625 inch (4.128 cm) and is constructed of stainless steel.

In Use

To use the adaptor 10 to convert a standard cartridge firing firearm into a muzzle loading firearm 100, the adaptor 10 is first mounted into the breech end 108A of the barrel 108 of the firearm 100 adjacent the receiver 104. Before mounting the adaptor 10, the center bore 110 of the barrel 108 adjacent the receiver 104 is threaded to allow for threadably mounting the adaptor 10 in the barrel 108. In the preferred embodiment, before mounting the breech plug 12 in the barrel 108, the nipple 16 is mounted in the breech plug 12. In an alternative embodiment (not shown), the nipple 16 is constructed as an integral part of the breech plug 12. To mount the nipple 16 in the breech plug 12, the breech end 16A of the nipple 16 is inserted into the forward end 12B of the breech plug 12. The nipple 16 is inserted until the second section 16D of the nipple 16 is fully within the second section 14B of the center bore 14 of the breech plug 12. The frusto-conical shaped second section 16D of the nipple 16 and the frusto-conical shaped second section 14B of the center bore 14 of the breech plug 12 act to correctly center the nipple 16 in the breech plug 12 such that the longitudinal axis A—A of the breech plug 12 is coaxial with the longitudinal axis B—B of the nipple 16. In the preferred embodiment, the nipple 16 is inserted into the center bore 14 of the breech plug 12 until the diameter of the second section 16D is greater than the diameter of the second section 14B of the center bore 14 of the breech plug 12. When correctly mounted, the forward end 16B of the nipple 16 is flush with the forward end 12B of the breech plug 12 such that the forward end of the adaptor 10 has a flat surface. In the preferred embodiment, the nipple 16 is permanently mounted in the center bore 14 of the breech plug 12 using any well known fastening means such as welding. When correctly mounted in the center bore 14 of the breech plug 12, the breech end 16A of the nipple 16 extends slightly beyond the breech end 12A of the breech plug 12 toward the receiver 104.

Once the nipple 16 is in place, the adaptor 10 is then mounted in the barrel 108 of the firearm 100. To mount the adaptor 10, the forward end 12B of the breech plug 12 is inserted into the breech end 108A of the barrel 108. The breech plug 12 is easily inserted until the forward end 12B of the breech plug 12 encounters the threads in the center bore 110 of the barrel 108. The breech plug 12 is then rotated such that the threads on the sidewall 12C of the breech plug 12 engage the threads in the center bore 110 of the barrel 108 (FIG. 2). In the preferred embodiment, to rotate the adaptor 10, the user uses a socket wrench which fits over the third section 16E of the nipple 16 and allows for rotation of the nipple 16 and breech plug 12. The breech plug 12 is preferably rotated into the barrel 108 until all the threads of the breech plug 12 are engaged by the threads in the center bore 110 of the barrel 108. In the preferred embodiment, when the adaptor 10 is fully mounted in the center bore 110 of the barrel 108, the breech end 108A of the barrel 108 extends beyond the breech end of the adaptor 10. Thus, the adaptor 10 is countersunk in the center bore 110 of the barrel 108. When correctly mounted, the breech plug 12 and the barrel 108 are preferably sealingly engaged. In an alternate embodiment (not shown), the breech plug 12 is constructed as an integral part of the barrel 108 to form an improved muzzle loading firearm 100.

Once the adaptor 10 is mounted in the barrel 108 of the firearm 100, the firearm 100 is ready to be used as a muzzle loading firearm 100. To load the firearm 100, propellant pellets 118 are first inserted into the forward end 108B of the barrel 108 such that the propellant pellets 118 are in contact with the forward ends 12B and 16B of the breech plug 12 and nipple 16. The propellant pellets 118 are preferably preformed pyrodex changes. The flat surface created by the nipple 16 and breech plug 12 allow the propellant pellet 118 to sit directly on the adaptor 10 over the center bore 18 of the nipple 16. In the preferred embodiment, three (3) to five (5) 50 gram propellant pellets 118 are used for an ignition cartridge 150 similar to a 45 ACP ignition cartridge. The propellant pellets 118 preferably have a center opening and are mounted in the barrel 108 such that the center openings of the propellant pellets 118 are coaxial with the center bore 18 of the nipple 16. In an alternative embodiment (not shown), black powder is used in place of the propellant pellets 118. In that embodiment, preferably 75 to 100 grains of black powder are used for an ignition cartridge 150 similar to a 45 ACP ignition cartridge. Next, the conical bullet 120 is slid into the forward end 108B of the barrel 108. The projectile is preferably either a conical bullet 120, a ball (not shown) or miniballs (not shown). In the preferred embodiment, the projectile is a conical bullet 120 mounted in a sabot 122. The end of the sabot 122 adjacent the propellant pellets 118 is preferably concave such as to provide maximum propellant force on the conical bullet 120. When the projectile is a ball, a greased patch (not shown) is optionally (not preferred) inserted into the barrel 108 with the projectile such that the patch is on top of the propellant pellets 118 or black powder and the projectile is on top of the patch. The greased patch assists in the insertion of the ball and also acts to ensure that the full force of the exploding propellant pellets 118 or black powder is transferred to the projectile when the firearm 100 is fired. The patch is particularly useful with rifle barrels.

Once the propellant pellets 118 and the conical bullet or other projectile 120 are positioned in the barrel 108, the bolt 106 is moved back to allow for loading of an ignition cartridge 150. The ignition cartridge 150 is loaded into the receiver 104 such that the hook of the extractor at the end of the bolt 106 grasps the head 150B of the ignition cartridge 150. Usually, the ignition cartridge 150 is loaded through a slot (not shown) in the top of the bolt 106. Next, the bolt 106 is moved forward toward the breech end 108A of the barrel 108 which moves the ignition cartridge 150 forward onto the nipple 16. The bolt 106 is then rotated to lock the bolt 106 in place. When the bolt 106 is locked in place, the ignition cartridge 150 is located in the adaptor 10 such that the cartridge casing 150A extends into the adaptor 10 between the nipple 16 and the first section 14A of the center bore 14 of the breech plug 12 (FIG. 8). Preferably, the cartridge casing 150A has a diameter such that when the ignition cartridge 150 is mounted in the adaptor 10, an outer surface of the cartridge casing 150A is adjacent an inner surface of the sidewall 12C of the breech plug 12 and an inner surface of the cartridge casing 150A is spaced apart from an outer surface of the nipple 16. In the preferred embodiment, the breech end 16A of the nipple 16 extends into the end 152B of the flash hole 152 in the head 150B of the ignition cartridge 150 such that the breech end 16A of the nipple 16 is adjacent the primer 154 and the primer 154 is positioned over the center bore 18 of the nipple 16. In an alternative embodiment, the breech end 16A of the nipple 16 contacts the primer 154. The conical shape of the breech end 16A of the nipple 16 and the size of the end 152B of the flash hole 152 of the ignition cartridge 150 enables the breech 16A of the nipple 16 to extend into the flash hole 152 of the ignition cartridge 150.

The firearm 100 is fired similarly to an ordinary firearm; by pulling the trigger 102. When the trigger 102 is pulled, the firing pin mechanism in the bolt 106 moves the firing pin 112 forward and into contact with the primer 154. Contact of the firing pin 112 with the primer 154 moves the ignition cartridge 150 forward such that in the instant of firing, the ignition cartridge 150 is tightly and sealingly mounted on the nipple 16 such that the flash hole 18 of the nipple 16 is in direct and sealed communication with the flash hole 152 of the ignition cartridge 150 and the primer 154. The bolt 106 acts to hold the ignition cartridge 150 still on the nipple 16 in a compression fit during firing. The spark of the primer 154 and ignition gases travel through the flash hole 152 in the head 150B of the ignition cartridge 150 and immediately down the center bore 18 of the nipple 16. The reduction in the diameter of the center bore 18 of the nipple 16 from the breech end 16A to the forward end 16B acts as a nozzle and increases the rate of movement of the gases as they pass through the nipple 16 and focuses the spark and ignition gases as they pass through the nipple 16. The seal formed between the flash hole 152 of the ignition cartridge 150 and the flash hole or center bore 18 of the nipple 16 forces the ignition gases into the center bore 18 of the nipple 16 and prevents the gases and propellant pellets 118 and residue or black powder residue from escaping from the center bore 18 of the nipple 16. This allows for better ignition and less blow back in the receiver 104 and firing mechanism which reduces the need to clean the receiver 104 and firing mechanism 112. If any gas does escape from the center bore 18 of the nipple 16, the gases preferably expand the cartridge casing 150A against the sidewall 12C of the breech plug 12 to prevent blow back on the bolt 106 or firing mechanism 112. Consequently, as a result of escaping gases, the cartridge casing 150A of the ignition cartridge 150 becomes friction fitted within the center bore 14 of the breech plug 12. The resulting close fit of the cartridge casing 150A prevents blow back of exploding gases and residue such as powder outside the ignition cartridge 150 which travels up through the center bore 18 of the nipple 16 to the ignition cartridge 150. Thus, when black powder is used, no black powder enters the receiver 104 which prevents the receiver 104 from becoming dirty. In the preferred embodiment where propellant pellets 118 are used, the spark travels through the center openings of the propellant pellets 118 and ignites all the propellant pellets 118 simultaneously. In the alternative embodiment where black powder is used, the spark ignites the black powder. The explosion of the propellant pellets 118 or black powder expels the projectile 120 from the barrel 108 of the firearm 100. Once the firearm 100 has been fired, the bolt 106 is moved backwards which causes the ignition cartridge 150 to be extracted from the adaptor 10 and ejected from the firearm 100. In the preferred embodiment, the adaptor 10 is removed to allow for cleaning of the firearm 100 and to allow the firearm 100 to be used as a standard rifle.

It is intended that the foregoing description be only illustrative of the present invention and that the present invention be limited only by the hereinafter appended claims.

I claim:

1. An adaptor for use in a muzzle loading firearm, having a receiver mounting a barrel and a blocking means movably mounted on the receiver for supporting a head of a cartridge during firing of the firearm, the head of the cartridge having a well with a primer held in the well with an opening in the head into the well from an inside of a casing of the cartridge the blocking means mounting a firing pin mechanism, the adaptor comprising:

(a) a plug having a first end and a second end with a sidewall extending therebetween and with a center bore extending therethrough along a longitudinal axis of the plug, the plug being configured to be inserted into the barrel in a sealed relationship to the barrel with the first end adjacent the blocking means; and (b) a nipple mounted in the center bore of the plug and having a first end and a second end with a sidewall extending therebetween and with a center bore extending therethrough in communication with the center bore of the plug, the sidewall at the first end having an angled outer surface wherein the sidewall of the nipple is spaced apart from the sidewall of the plug such that the casing of the cartridge can be mounted on the nipple, such that the casing extends into the center bore of the plug adjacent the sidewall of the plug and the first end of the nipple extends into the opening of the head adjacent the primer such that the center bore of the nipple is in direct communication with the primer and wherein during firing of the muzzle loading firearm, the firing pin mechanism engages the primer and produces ignition of propellant material in the barrel through the center bore of the plug and the center bore of the nipple.

2. The adaptor of claim 1 wherein an outer surface of the sidewall of the plug has threads between the ends and wherein the barrel of the muzzle loading firearm has threads adjacent the receiver of the firearm which engage the threads of the plug and act to hold the plug in the sealed relationship in the barrel of the firearm.

3. The adaptor of claim 1 wherein the plug is inserted into the barrel such that a first end of the plug is adjacent and spaced inward from a first end of the barrel toward a second end of the barrel.

4. The adaptor of claim 1 wherein the nipple and plug are secured together and wherein a portion of the outer surface of the sidewall of the nipple between the ends is configured to accommodate a wrench to allow for removal of the nipple and plug from the barrel.

5. The adaptor of claim 1 wherein a diameter of the center bore of the nipple is substantially the same as a diameter of the opening in the head of the cartridge adjacent the primer.

6. The adaptor of claim 1 wherein the center bore of the plug is coaxial with the center bore of the nipple.

7. The adaptor of claim 1 wherein a diameter of the center bore of the nipple adjacent the second end of the nipple is less than a diameter of the center bore of the nipple adjacent the first end of the nipple such that a rate of movement at which gases exit the center bore at the second end is greater than a rate of movement at which the gases enter the center bore at the first end.

8. The adaptor of claim 1 wherein the center bore of the plug has a first portion adjacent the first end of the plug and a second portion adjacent the second end of the plug and wherein the second portion has a frusto-conical shape.

9. The adaptor of claim 8 wherein the nipple has a portion adjacent the second end of the nipple which has a frusto-conical shape and is configured to fit within the second portion of the center bore of the plug.

10. The adaptor of claim 1 wherein the outer surface of the nipple at the first end has a conical shape with a truncated apex, and wherein the truncated apex forms the first end of the nipple.

11. The adaptor of claim 10 wherein the outer surface of the sidewall of the nipple adjacent the first end has a 60° angle toward the first end.

12. The adaptor of claim 1 wherein a diameter of the nipple at the first end is substantially equal to a diameter of the center bore of the nipple at the first end.

13. The adaptor of claim 1 wherein when the adaptor is mounted in the barrel of the firearm, the first end of the plug is spaced inward from a first end of the barrel away from the receiver and the first end of the nipple extends beyond the first end of the plug toward the receiver wherein when the cartridge is mounted on the nipple, the head of the cartridge extends beyond the barrel into the receiver.

14. An ignition system for use in a muzzle loading firearm having a receiver and a barrel with a blocking means slidably mounted on the receiver and mounting a firing pin mechanism, the ignition system comprising:

(a) a plug having a first end and a second end with a sidewall extending therebetween and with a center bore extending therethrough along a longitudinal axis of the plug, the plug being configured to be inserted into the barrel in a sealed relationship to the barrel with the first end adjacent the blocking means;

(b) a nipple mounted in the center bore of the plug and having a first end and a second end with a sidewall extending therebetween and with a center bore extending therethrough in communication with the center bore of the plug, the sidewall at the first end having an angled outer surface wherein the sidewall of the nipple is spaced apart from the sidewall of the plug; and (c) a cartridge configured to be mounted over the first end of the nipple and into the center bore of the plug, the cartridge having a head with a casing extending outward from the head, the head having a well on one side with a primer held in the well and an opening into the well adjacent the primer wherein an end of the opening opposite the primer is configured to accommodate the first end of the nipple such that when the blocking means engages the head of the cartridge with the firing pin mechanism adjacent the primer and moves the cartridge over the nipple, the first end of the nipple moves into the opening of the head such that the center bore of the nipple is in fluid communication with the primer, wherein during firing of the muzzle loading firearm, the firing pin mechanism engages the primer and produces ignition of propellant material in the barrel through the center bore of the plug and the center bore of the nipple.

15. The system of claim 14 wherein the nipple has a first section, a second section and a third section with the first section adjacent the first end of the nipple and wherein the casing of the cartridge extends over only a portion of the first section of the nipple.

16. The system of claim 14 wherein the cartridge extends into the center bore of the plug such that an outer surface of the casing is adjacent an inner surface of the sidewall of the plug and an inner surface of the casing is spaced apart from the outer surface of the nipple.

17. The system of claim 14 wherein the opening in the head of the cartridge is of a size so that the first end of the nipple extends into the opening and contacts the primer when the firing pin engages the primer and moves the cartridge toward the nipple.

18. The system of claim 14 wherein when the system is mounted in the barrel of the firearm, the first end of the plug is spaced inward from a first end of the barrel away from the receiver and the first end of the nipple extends beyond the first end of the plug toward the receiver wherein when the cartridge is mounted on the nipple, the head of the cartridge extends beyond the barrel into the receiver.

19. The system of claim 14 wherein a first end of the nipple extends beyond a first end of the plug in a direction opposite the second end of the plug.

20. The system of claim 14 wherein a tool is provided for chamfering the opening in the head of the cartridge to enable the first end of the nipple to extend into the opening and adjacent the primer.

21. The system of claim 14 wherein the outer surface of the nipple at the first end has a conical shape with a truncated apex, and wherein the truncated apex forms the first end of the nipple.

22. The system of claim 21 wherein the outer surface of the sidewall of the nipple adjacent the first end has a 60° angle toward the first end.

23. The system of claim 14 wherein a diameter of the nipple at the first end is substantially equal to a diameter of the center bore of the nipple at the first end.

24. The system of claim 14 wherein a diameter of the center bore of the nipple adjacent the second end of the nipple is less than a diameter of the center bore of the nipple adjacent the first end of the nipple such that a rate of movement at which gases exit the center bore at the second end is greater than a rate of movement at which the gases enter the center bore at the first end.

25. In a muzzle loading firearm having a receiver mounting a barrel and having a blocking means for holding a cartridge during firing of the firearm and mounting a firing pin mechanism, a head of the cartridge having a well with a primer held in the well with an opening in the head into the well from an inside of a casing of the cartridge the improvement which comprises as part of the barrel:

(a) a center bore provided by an inside wall in the barrel having a first section adjacent the receiver and an opposed third section with a second section therebetween extending along a longitudinal axis of the barrel, a diameter of the first section being less than a diameter of the third section and the second section having a frusto-conical shape with a first end adjacent the first section and a second end adjacent the third section wherein a diameter of the first end is less than a diameter of the second end; and (b) a nipple having a first end and a second end and mounted in the first and second sections of the center bore and having a first section adjacent the first end and a second section adjacent the second end with a bore extending therethrough in communication with the third section of the center bore, the first section having an outside wall in spaced relationship to the inside wall of the barrel, the second section of the nipple having a frusto-conical shape and configured to be mounted in the second section of the center bore, the nipple configured to mount the casing of the cartridge so that the casing extends into a first section of the center bore adjacent the inside wall of the barrel and the nipple extends into the opening of the head adjacent the primer wherein during firing of the muzzle loading firearm, the firing pin engages the primer and produces ignition of powder in the third section of the center bore through the bore of the nipple.

26. The firearm of claim 25 wherein the outer surface of the nipple at the first end has a conical shape with a truncated apex, wherein the truncated apex forms the first end of the nipple.

27. The firearm of claim 26 wherein the outer surface of the sidewall of the nipple adjacent the first end has a 60° angle toward the first end.

28. The firearm of claim 25 wherein a diameter of the nipple at the first end is substantially equal to a diameter of the center bore of the nipple at the first end.

* * * * *